US006953483B2

(12) United States Patent
Litke et al.

(10) Patent No.: US 6,953,483 B2
(45) Date of Patent: Oct. 11, 2005

(54) ALOE VERA PROCESSED LEATHER AND LEATHER GLOVES, GARMENTS, SHOES AND SANDALS MADE FROM ALOE VERA PROCESSED LEATHER AND A PROCESS FOR MAKING ALOE VERA PROCESSED LEATHER

(76) Inventors: Kenneth S. Litke, 54 Holmes St., Marion, MA (US) 02738; John D. Widdemer, 503 N. Perry St., Johnstown, NY (US) 12095

( * ) Notice: Subject to any disclaimer, the term of this patent is extended or adjusted under 35 U.S.C. 154(b) by 78 days.

(21) Appl. No.: 10/382,134

(22) Filed: Mar. 5, 2003

(65) Prior Publication Data

US 2003/0217416 A1 Nov. 27, 2003

Related U.S. Application Data

(60) Provisional application No. 60/362,627, filed on Mar. 5, 2002.

(51) Int. Cl.[7] ..... C14C 3/08

(52) U.S. Cl. ..... 8/94.33; 8/94.1 R; 8/94.19 R; 8/94.13

(58) Field of Search ..... 8/94.33, 94.1 R, 8/94.19 R, 94.13

(56) References Cited

U.S. PATENT DOCUMENTS 4,661,476 A * 4/1987 Lane et al. ..... 514/60
6,204,208 B1 * 3/2001 Krzysik et al. ..... 442/118
6,338,340 B1 * 1/2002 Finch et al. ..... 128/205.27
6,350,399 B1 * 2/2002 Cook et al. ..... 264/129

* cited by examiner

*Primary Examiner*—Necholus Ogden
*Assistant Examiner*—D. G. Hamlin
(74) *Attorney, Agent, or Firm*—Aufrichtig, Stein & Aufrichtig, P.C.; Peter D. Aufrichtig

(57) ABSTRACT

An aloe vera re-tanned leather for use in a glove, garment, sandal or shoe. The leather includes tanned leather having an internal fiber matrix. An aloe vera powder of aloe vera particles in a gel carrier is in the tanned leather in a retanning process so that the aloe vera particles in the gel carrier penetrate the internal fiber matrix and are temporarily trapped within the internal fiber matrix. The trapped aloe vera particles in the tanned leather gradually emerge from the inside surface of the leather to be in contact with, lubricate and treat the skin of a wearer of the glove, garment, sandals or shoes, whereby the aloe vera lubricated leather is particularly suitable for use in gloves, garments, sandals or shoes which come in contact with a wearer's skin. The process of retanning the leather to include the aloe vera in the leather and the gloves, garments, sandals and shoes incorporating the aloe vera retaining leather is also described.

7 Claims, 2 Drawing Sheets

ALOE VERA PROCESSED LEATHER AND LEATHER GLOVES, GARMENTS, SHOES AND SANDALS MADE FROM ALOE VERA PROCESSED LEATHER AND A PROCESS FOR MAKING ALOE VERA PROCESSED LEATHER

This application claims the priority of provisional application No. 60/362,627, filed on Mar. 5, 2002.

BACKGROUND OF THE INVENTION

The invention is generally directed to a leather processed to contain Aloe Vera gel that will gradually emerge from the leather during use and leather gloves, garments, shoes and sandals made from it that will provide comforting and healthful benefits to the wearer's skin. These benefits particularly apply in sports, gardening and work glove applications that are used in high friction functions. In particular, the invention is directed to specific methods for production of leather containing Aloe Vera gel and glove, garments, shoes and sandals made from it. Another benefit of the invention is the natural lubrication of the leather provided by Aloe Vera reducing the use of expensive and sometimes noxious artificial fats and oils.

Many sports require swinging motions while gripping an implement, for instance, a golf club or barbell. Other activities such as carpentry, working with heavy construction tools or ropes (such as in sailing) also create tremendous friction inside the gloves that are worn to improve grip and protect the hand in these circumstances. Often abrasions or even blisters are formed on the skin, caused by the rubbing of the inside surface of normal leather.

It has long been recognized that Aloe Vera gel has anti-inflammatory, burn and wound healing benefits, as well as being instrumental in cell restoration and growth and the regeneration of damaged skin tissue. It is also an excellent lubricant and moisturizer and is thought to reduce joint and muscle pain associated with tendinitis and arthritis. It is also antibacterial and anti-fungal. Therefore, gloves made from Aloe Vera processed leather help to protect a wearer's hand from discomfort and infection and to prevent or heal abrasions and blisters is desired.

It is known that molded latex surgical gloves have been produced with Aloe Vera sprayed on after manufacture to help surgeons avoid the contact allergies associated with such gloves and to provide anti-bacterial protection to the surgeon's hands. This process is a surface application only and the Aloe Vera is only good for one use, after which the gloves are discarded. While a single use application is useful in surgical gloves which are discarded in any event after one use, it is not useful for other types of gloves, which are reused and shoes, sandals and other garments which are intended to be used repeatedly. Accordingly, there is a need for an improved aloe vera processed leather and leather gloves, garments, shoes and sandals made from aloe vera processed leather and a process for making aloe vera processed leather where the aloe vera remains in the leather so that the positive effects of contact between the aloe vera enriched leather and the wearer's skin is achieved for an extended period of time.

SUMMARY OF THE INVENTION

The invention is generally directed to leather into which Aloe Vera gel is introduced as part of the re-tanning process. It is also directed to a supplementary application process to the suede, or back side, of the leather (that will be in contact with a glove wearer's hand) so that initial hand contact is with the surface application and as the glove is used the internal gel gradually works to the inner surface providing lasting benefits.

The invention is also directed to a method of introducing the Aloe Vera gel into the leather during the retanning process and to a method of applying a surface coating of Aloe Vera gel and carrageenan to the back, or inner, side of the leather.

The invention is also directed to leather glove products made from Aloe Vera processed leather that will provide health and comfort benefits to the wearer.

Still other objects and advantages of the invention will, in part, be obvious and will, in part, be apparent from the specification.

The invention accordingly comprises the features of construction, combinations of elements and arrangements of parts which will be exemplified in the construction as hereinafter set forth, and the scope of the invention will be indicated in the Claims.

BRIEF DESCRIPTION OF THE DRAWINGS

For a fuller understanding of the invention, reference is had to the following descriptions taken in connection with the accompanying drawings, in which.

DETAILED DESCRIPTION OF THE PREFERRED EMBODIMENTS

Figure 2:
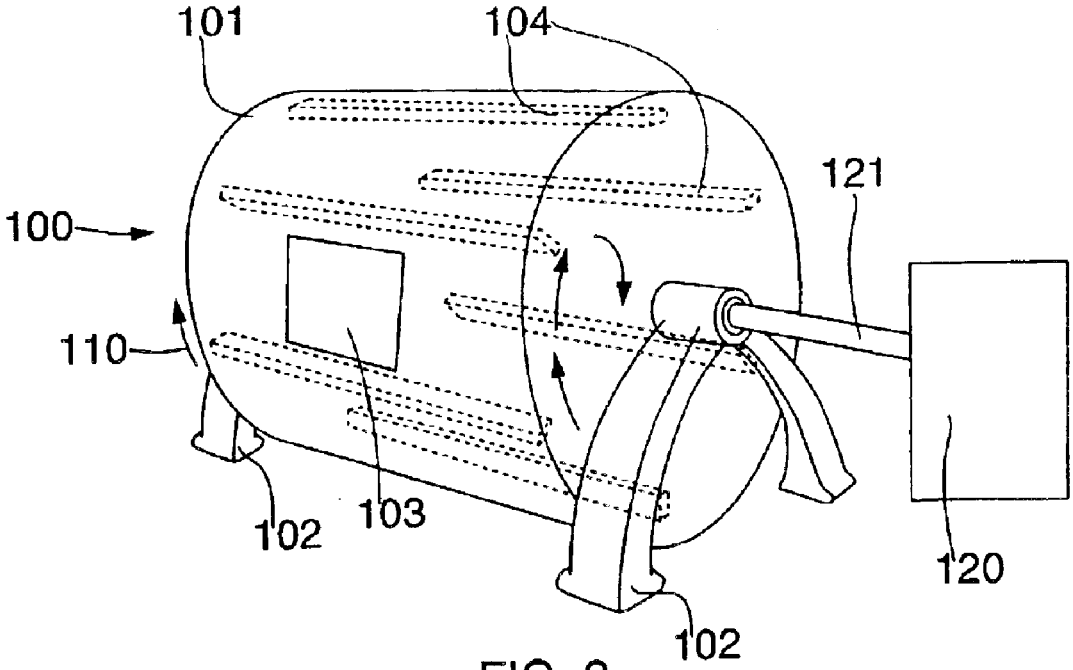
FIG. 2 is a perspective view of a rotating drum for re-tanning leather in accordance with the invention.

Leather tanning can take many forms and be practiced on a variety of raw materials. However, most leather today is brought to a tanned stage with the use of chromium salts, natural oils such as fish oil or other tanning agents such as aldehydes. This stage imparts permanency to the animal fiber structure. Whatever its basic tanning method, leather in the tanned stage can be re-tanned, during which fats and oils are inserted into the leather to lubricate it and to give it other needed characteristics. During this process, while the leather fiber structure is "opened up" the process of the invention then inserts Aloe Vera gel into the fiber structure by mechanical drumming. In a preferred embodiment chrome tanned skins are added to a rotating drum. Reference is made to FIG. 2 wherein a rotating drum, generally indicated as 100, is depicted. Drum 100 includes a wooden drum portion 101, supported on legs 102 for rotation about a horizontal axis as shown by arrow 110. A motor 120 is used with linkage 121 to drive the rotation of drum 101. Motor 120 and linkage 121 are conventional elements. Drum 101 also includes a flap 103 adapted to open when the skins are to be added or removed from drum 101 and to seal tightly when the re-tanning process is underway. Drum 101 also includes interior baffles 104 used to mix the skins with the various liquids used in the retanning process and to prevent skins sticking to each other. The wooden drum is well known in the tanning and re-tanning arts and can be used for a primary tanning process as well.

The Aloe Vera gel is purchased in a spray dried powder form that is first reconstituted with 200 parts of water by weight. The Aloe Vera to be used in making Aloe Vera leather is obtained in spray dried, powdered form such as product 5010XP from Aloecorp, 100 Technology Drive, Broomfield, Colo. 80021. This powder has a white to light tan appearance; an absorbance @ 400 mm of NMT 0.50; turbidity of NMT 0.20; pH value of 3.5 to 5.0; moisture content of NMY 10%; ash content of NMT 45%; an aerobic plate count of <100 CFU/g and a mold and yeast content of <50 CFU/g. In this form it is able to be stored and transported efficiently and safely and has a shelf life of two years. After being reconstituted and applied in the Aloe Leather process it has permanent shelf life.

The Aloe powder has had all the familiar "gel" of an Aloe leaf removed. This gel is composed of water which makes up 96% of the Aloe plant. The remaining 4% (the powder) contains all 75 chemical ingredients, many of which make Aloe beneficial to the human body. Some of the benefits (some known since ancient Egyptian times) are: the ability to heal abrasions and wounds through protecting the body's superoxide dismutase and glutathione; and by stimulating fibroblasts, which has an anti-inflammatory effect. Also, benefits include protection against the harmful effects of ultraviolet light through immune restoration and stimulation of collagen and elastin synthesis. Other benefits are anti-fungal and anti-bacterial effects and hydration of the skin.

A substitute gel must be added to the dried powder to carry the active ingredients into the leather and back out as the product is used. The preferred gel substitute is carrageenan which has beneficial characteristics of its own. This is obtained in a spray dried powder form such as product Viscarin 389 from FMC Biopolymer, 1735 Market Street, Philadelphia, Pa. Carrageenan is a naturally occurring family of carbohydrates extracted from red seaweed. It has the ability to form an almost infinite variety of gels at room temperature. It will thicken, suspend and stabilize particles (Aloe powder in this case) and is stable through a broad range of temperatures. Carrageenan is a highly effective dispersant and works well in carrying the Aloe ingredients into the triple helix fiber structure of the leather where it is trapped by the process described below.

In its natural state, carrageenan, like Aloe, is composed of 96% water. It absorbs and manages moisture and when saturated forms a film, or barrier to more water but not to water vapor. This imparts valuable "breathing" characteristics to leather while keeping it highly water resistant. Carrageenan, like Aloe, interacts with human carotene to improve skin health and softness.

THE PROCESS

Figure 1:
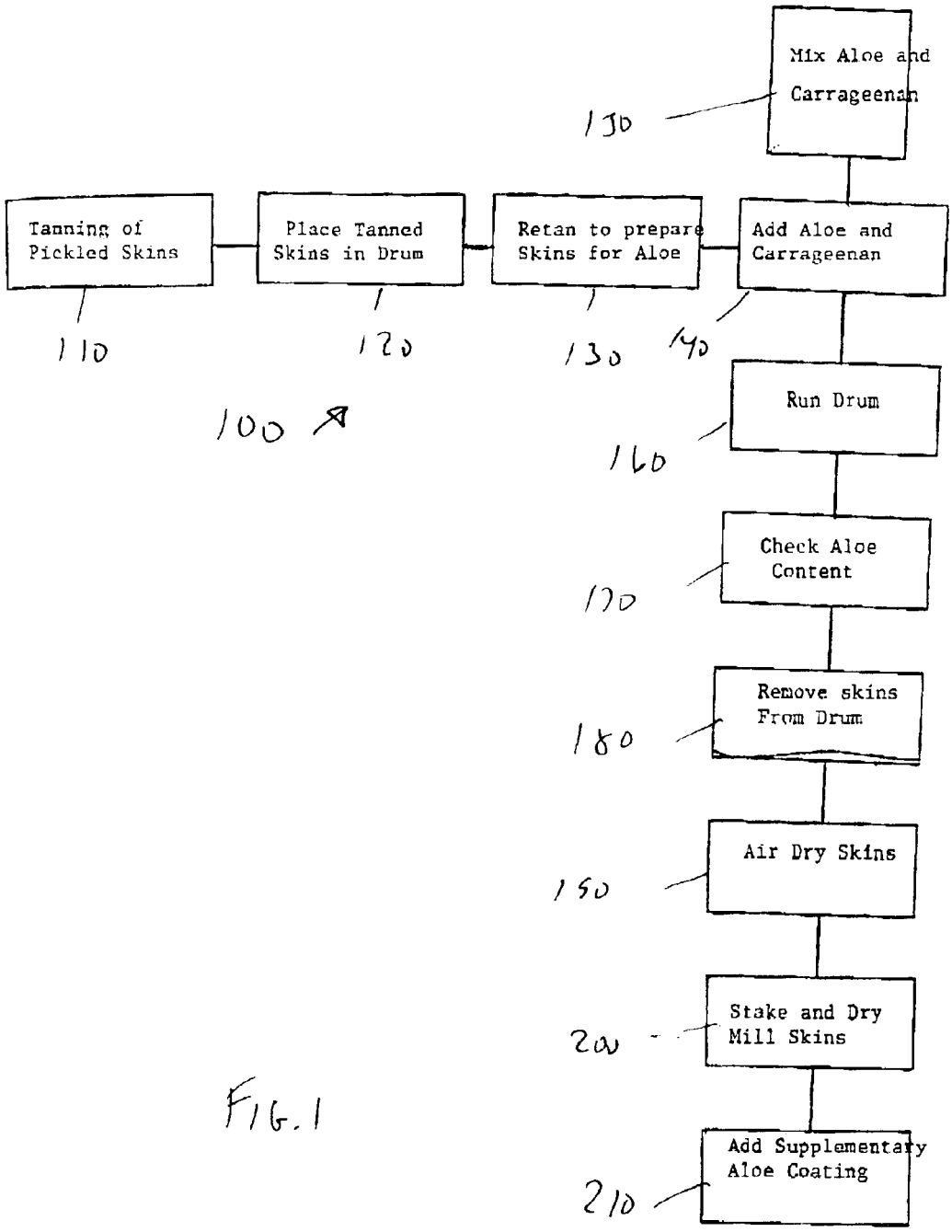
FIG. 1 is a flow chart diagram of an aloe vera retanning process in accordance with a preferred embodiment of the invention.

Reference is made to FIG. 1 wherein a flow chart diagram of the steps involved in the process of the making of the Aloe Leather is depicted generally as element 100. In step 110 the pickled skins are tanned. Next, in step 120 the tanned pickled skins are placed in the drum shown in FIG. 2. In step 130 a retanning to prepare the skins for the Aloe is performed. Next, in step 150, the Aloe and carrageenan are mixed and then, in step 140, added to the drum. In step 160 the drum is run. In step 170 the Aloe content of the leather is checked and, if appropriate, in step 180 the skins are removed from the drum. Next, in step 190, the skins are air dried. In step 200 the skins are staked and dry milled. Finally, in step 210, the supplementary Aloe coating is added to a surface of the skins.

We note that in describing the various steps, various terms are utilized. Fat liquor is used to lubricate the fibers and to enhance the softness of the leather. Syntans or synthetic tanning agents are used to improve the tensile strength and the grain pattern of the skins. Degreasing is performed to remove high amounts of natural fat and to make the leather odorless. A whitening agent, often a casein base, is used to impart an even whiter appearance in the leather and it also helps in covering the natural black pigments. Preservatives are used to prevent bacterial decomposition of leather during the tanning process and subsequent storage.

The fiber structure of leather must be specially prepared to accept the Aloe/carrageenan mixture. Beginning with skins that have had their hair removed and been pickled by any of several well known processes the skins are placed in a wooden drum 8 feet by 6 feet with 50% water and 5% common salt of pickle weight. The drum is rotated for 20 minutes. Then a "degreasing" process occurs in which 1.5% Supratan 80 (a degreasing agent), 1.2% Sodium Bicarbonate are added and the drum is run for a total of 30 minutes in ten minute cycles after each of which 1.5% Supratan 80 and 1.2 Sodium Bicarbonate are again added (checking that the pH remains at 5.2). Next 7% of 100% salt solution is added and the drum rotated for 20 minutes.

After draining, the wet skins are again run for 20 minutes after adding 1.5% Supratan 80 (a degreasing agent) and again drained. Next a 200% salt solution is added and drummed for 20 minutes and drained. Again a 200% salt solution is added and drummed for 20 minutes and drained. Next 100% water and 7% common salt are added and drummed for 20 minutes. Then 0.6% of sulphuric acid is added and drummed for a total of 30 minutes in ten minute intervals adding 0.6% of sulphuric acid between each drumming. The pH at this stage should be 3.5.

Next the skins are bleached to remove dead hairs and natural pigments. The skins must be cleaned out perfectly to accept the aloe/carrageenan solution. In bleaching, 0.6% of potassium permanganate is added to the decreased skins in their "float" and drummed for 40 minutes and drained. Then 200% water is added and 7% common salt and run for 20 minutes and drained. Then 100% water is added and 7% common salt and this is drummed for 20 minutes. Next 1.5% sodium bisulphate is added and drummed for 20 minutes. Again 1.5% of sodium bisulphate is added and drummed for 20 minutes. Next 1.2% of Hydrochloric acid is added and drummed for 30 minutes. The drum is then drained. Next 200% water is added and 7% common salt and drummed for 20 minutes. Then 1.5% sodium bisulphate is added and drummed for 20 minutes. Again 1.5% sodium bisulohite is added and drummed for 20 minutes. Then 1.2% of hydrochloric acid is added and drummed for 30 minutes and then drained. Next 200% of water is added and 7% of common salt and drummed for 20 minutes and then drained. Then 7% of 100% salt solution is added and drummed for 20 minutes. At this stage the skins are well cleaned out of natural contaminants that would interfere with the acceptance of the aloe/carrageenan solution.

The next state is Pretanning to prepare the skins for the tanning process. To the preceding "float" add 1.0% Proval BA (a fat liquor), 1.5% Pelgrassol LP (a fat liquor) and 3% Novaltan PF (a synthetic tanning agent). Drum for 30 minutes. Next 0.4% of formic acid is added and drummed for three ten minute periods, adding 0.4% o formic acid at each stage. The pH should be 3.0 at this stage. The skins are now ready for tanning.

In the tanning process 4% chrome powder is added to the skins in their "float" and drummed for 30 minutes. Next 3.5% of chrome powder is added and drummed for 90 minutes. Next 200% of water is added and drummed for 20 minutes. This "float" is left overnight. The next day the drum is run for 30 minutes and the tanning is complete.

The skins are then neutralized in a basification process. To the existing "float" 1% sodium formate is added and drummed for 30 minutes then 1% sodium bicarbonate is added in four times at 10 minute intervals and the pH is checked to be between 3.8 and 3.9. Then 1% Busan 30L (a preservative) is added and drummed for 20 minutes. The drum is then drained, the skins are piled and left to drain and age for 24 hours. They are then in a "wet blue" tanned stage. They are then run through a "setting machine" which has a roller with dull blades that stretch the leather and remove creases. The leather is then shaved on a shaving machine with a roller with sharp blades and the excess flesh and fat is removed and thickness is made uniform, better to accept the aloe/carrageenan solution evenly. The skins are then at a thickness of 0.4 to 0.45 mm.

The Aloe/carrageenen process takes place next. Based on the shaved wet blue weight 200% of water is added and 0.2% Supralan 80 and 0.2% formic acid and drummed for 30 minutes. The pH should be at 3.6. The skins are drained and washed. Next 200% water and 4% Novaltan PF (a syntan) are added and drummed for 20 minutes. This accomplishes "retanning". Next the skins are prepared to receive te Aloe/carrageenan and fat liquors. To the existing "float" are added 1% Pelgrassol SF (a fat liquor) and drummed for 20 minutes and 1% Tannit LW (a fat liquor) and drummed for 20 minutes. Then 0.5% of chrome powder is added and drummed for 20 minutes. Next the skins are again neutralized by adding 1.5% sodium formate and run for 10 minutes at which point the pH should be 4.0. The skins are then drained and washed. Next 100% of water at 60 degrees C. is added and 3% Novaltan PF (a syntan) and drummed for 20 minutes. Then the skins are drummed for 90 minutes, adding 15% of Proval PM (a fat liquor) at the end of each 30 minute period. Next 1.5% of neosyn White B (a whitening agent) is added and drummed for 40 minutes. Next the skins are drummed for 30 minutes in two stages of 10 minutes each adding 2.5% formic acid at each stage. Then the skins are drummed an additional 30 minutes.

The Aloe/carrageenan solution to insert into the fiber structure of the skins is prepared with 8% soft water, 0.75 grams per skin of carrageenan powder and 0.5 grams per skin of aloe powder and added to the drum. The skins are then run for 60 minutes. The skins are drained. Next 100% of water is added to the skins with 0.5% of Proval S (a fat liquor) and run for 30 minutes. Then 1% of formic acid is added and drummed for 30 minutes. The skins are drained and washed. It is preferable to check the Aloe content of the skins at this stge. This can be done by an analytical method developed by Wills and Company B.V. of Badhoevendorp, NL that measures the presence of AVMP (Aloe Vera Mucilaginous Polysaccharides) in the leather or by deduction by checking the Aloe content of the "float" after-it is drained form the skins. The skins are then suspended to air dry.

The final process prepares the skins for the supplementary coating of the back (suede) side of the leather. The skins are "staked' in a pneumatic staking machine that stretches and relaxes them. Next they are Wheel Staked in a machine with blunt blades on a metal roller. This further relaxes the fiber structure of the skin. Next the skins are dry milled (drummed without liquid) for 12 hours. This further softens the leather. The Aloe/carrageenan solution for application to the suede side of the skin is then prepared. To 110 ml of water add 1.4 grams of Aloe powder per 5 sq. ft. of leather and 1.4 grams of carrageenan powder per 5 sq. ft. of leather. Mix well until a gel is formed. The gel can be applied by one pass of spray coating or one pass of roller coating.

The Aloe impregnated leather is particularly suitable for leather products (gloves, shoes, sandals or garments that are used in activities such as golfing, handball, racquet sports, bicycling, baseball, fitness exercises, gardening, construction and any other activities where friction between the user's skin and the inner surface of leather make contact. Also, Aloe Leather has benefits in products such as women's dress gloves where improving skin quality in cold weather is an issue.

Accordingly, an improved finished leather is provided in which Aloe and carrageenan are trapped within the fiber structure and coated on the inner surface to emerge with use and provide long lasting benefits to the user.

It will thus be seen that the objects set forth above, among those made apparent in the preceding description, are efficiently obtained and, since certain changes may be made in the above constructions without departing from the spirit and scope of the invention, it is intended that all matter contained in the above description or shown in the accompanying drawings shall be interpreted as illustrative, and not in a limiting sense.

It is also to be understood that the following claims are intended to cover all of the generic and specific features of the invention, herein described and all statements of the scope of the invention which, as a matter of language, might be said to fall therebetween.

What is claimed is:

1. An aloe vera re-tanned leather for use in a glove, garment, sandle or shoe, comprising:

a tanned leather having an internal fiber matrix;

an aloe vera powder of aloe vera particles in a gel carrier, in the tanned leather due to a retanning process so that the aloe vera particles in the gel carrier penetrate the internal fiber matrix and are temporarily trapped within the internal fiber matrix; and the trapped aloe vera particles in the tanned leather gradually emerge from the inside surface of the leather to be in contact with, lubricate and treat the skin of a wearer of the glove, garment, sandals or shoes.

2. The aloe vera re-tanned leather of claim 1 wherein the aloe vera powder is suspended in a carrageenen gel.

3. The aloe vera lubricated leather of claim 2 wherein the carrageenan is added in a powder form generally in a greater amount than the aloe vera powder and mixed into a gel with water.

4. A glove, comprising:

a tanned leather having an internal fiber matrix;

an aloe vera powder of aloe vera particles in a gel carrier, in the tanned leather so that the aloe vera particles in a gel carrier penetrate the internal fiber matrix and are temporarily trapped within the internal fiber matrix; and the trapped aloe vera particles in the tanned leather gradually emerge from the inside surface of the leather to be in contact with, lubricate and treat the skin of a wearer of the glove.

5. A garment, comprising:

a tanned leather having an internal fiber matrix;

an aloe vera powder of aloe vera particles in a gel carrier, in the tanned leather so that the aloe vera particles penetrate the internal fiber matrix and are temporarily trapped within the internal fiber matrix; and the trapped aloe vera particles in the tanned leather gradually emerge from the inside surface of the leather to be in contact with, lubricate and treat the skin of a wearer of the garment.

6. Sandals, comprising:

a tanned leather having an internal fiber matrix;

an aloe vera powder of aloe vera particles in a gel carrier, in the tanned leather so that the aloe vera particles penetrate the internal fiber matrix and are temporarily trapped within the internal fiber matrix; and the trapped aloe vera particles in the tanned leather gradually emerge from the inside surface of the leather to be in contact with, lubricate and treat the skin of a wearer of the sandals.

7. Shoes, comprising:

a tanned leather having an internal fiber matrix;

an aloe vera powder of aloe vera particles in a gel carrier, in the tanned leather so that the aloe vera particles penetrate the internal fiber matrix and are temporarily trapped within the internal fiber matrix; and the trapped aloe vera particles in the tanned leather gradually emerge from the inside surface of the leather to be in contact with, lubricate and treat the skin of a wearer of the shoes.

* * * * *